US009750974B2

(12) United States Patent
Whitaker

(10) Patent No.: US 9,750,974 B2
(45) Date of Patent: Sep. 5, 2017

(54) REHABILITATION AND MOBILITY IMPROVEMENT APPARATUS AND METHOD OF USE

(71) Applicant: Korey K. Whitaker, Ogden, UT (US)

(72) Inventor: Korey K. Whitaker, Ogden, UT (US)

( * ) Notice: Subject to any disclaimer, the term of this patent is extended or adjusted under 35 U.S.C. 154(b) by 0 days.

(21) Appl. No.: 15/345,931

(22) Filed: Nov. 8, 2016

(65) Prior Publication Data

US 2017/0050082 A1 Feb. 23, 2017

(51) Int. Cl.

| | |
|---|---|
| ***A63B 21/00*** | (2006.01) |
| ***A63B 21/02*** | (2006.01) |
| ***A63B 21/06*** | (2006.01) |
| ***A63B 22/00*** | (2006.01) |
| ***A63B 22/20*** | (2006.01) |
| ***A63B 23/035*** | (2006.01) |
| ***A63B 23/04*** | (2006.01) |
| ***A63B 23/12*** | (2006.01) |
| ***A63B 71/00*** | (2006.01) |

(52) U.S. Cl.

CPC ..... *A63B 23/0355* (2013.01); *A63B 21/0004* (2013.01); *A63B 21/0618* (2013.01); *A63B 21/4015* (2015.10); *A63B 21/4019* (2015.10); *A63B 21/4034* (2015.10); *A63B 21/4035* (2015.10); *A63B 22/20* (2013.01); *A63B 23/03508* (2013.01); *A63B 21/023* (2013.01); *A63B 23/0405* (2013.01); *A63B 23/1209* (2013.01); *A63B 2022/0092* (2013.01); *A63B 2071/0063* (2013.01); *A63B 2209/10* (2013.01)

(58) Field of Classification Search

CPC . A63B 21/004; A63B 21/00185; A63B 21/22; A63B 22/20; A63B 23/0211; A63B 23/03516; A63B 23/1236

See application file for complete search history.

(56) References Cited

U.S. PATENT DOCUMENTS

| | | | | |
|---|---|---|---|---|
| 2004/0145113 | A1* | 7/2004 | Giegerich | A63B 67/04 273/108.1 |
| 2015/0209612 | A1* | 7/2015 | Shen | A63B 21/068 482/147 |
| 2016/0175635 | A1* | 6/2016 | Westenberg | A63B 21/0004 482/114 |
| 2016/0220862 | A1* | 8/2016 | Johnson | A63B 22/20 |

* cited by examiner

*Primary Examiner* — Sundhara Ganesan
*Assistant Examiner* — Jennifer M Deichl
(74) *Attorney, Agent, or Firm* — Michael R. Schramm

(57) ABSTRACT

The present invention is a rehabilitation and mobility improvement apparatus (RMIA) and method of use for use in providing increased mobility in persons having reduced strength and mobility due to for instance injury or illness. The apparatus is adapted so as to allow a person who could not readily slide or move their arm or other mobility reduced appendage (MRA) to slide or move their MRA, such as across a flat surface such as a table top or a floor, so as to provide exercise for such MRA, and so as to increase strength and mobility in such MRA.

20 Claims, 6 Drawing Sheets

REHABILITATION AND MOBILITY IMPROVEMENT APPARATUS AND METHOD OF USE

FIELD OF THE INVENTION

The present invention relates to rehabilitation devices, and more especially to device that provide for increased mobility in persons having injuries or illnesses that have otherwise caused decreased mobility in an extremity of such persons.

BACKGROUND OF THE INVENTION

Many people having an injury or illness suffer from decreased mobility or range of motion in for instance an arm or a leg. Such reduction in mobility can result in atrophy of remaining viable good muscle tissue. Often, such persons, if they had a means of exercising their remaining good muscles, could increase their strength and mobility but for a means to engage in such exercise. For instance, if a person could move their arm in a planar (flat) motion when subject to little or reduced resistance, such person could benefit from such exercise. However, because most surfaces where the person would otherwise move their arm are not adapted to providing for reduced resistance, such person is not readily able to avail himself to such beneficial exercise. Various devices such as traction devices or crutches or the like are known and are used in rehabilitation in for persons having an injury or illness that has caused reduction of mobility in such persons. However, such devices are often highly specialized to a particular rehabilitation task and/or are relatively complex and/or expensive, and are not adapted to providing for the reduced resistance motion.

SUMMARY OF THE INVENTION

The present invention is a rehabilitation and mobility improvement apparatus (RMIA) and method of use for use in providing increased mobility in persons having reduced strength and mobility due to for instance injury or illness. The apparatus preferably defines a generally flat disc shaped member—somewhat analogous to an air hockey mallet (see Appx A). The apparatus preferably includes a handle, a strap for secure the apparatus to a user's hand (or other body part such as an arm or foot) and a friction reduce device such as a plurality of roller devices mounted to the lower surface of the disc member. The apparatus is adapted so as to allow a person who could not readily slide or move their arm or other mobility reduced appendage (MRA) to slide or move their MRA, such as across a flat surface such as a table top or a floor, so as to provide exercise for such MRA, and so as to increase strength and mobility in such MRA.

DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
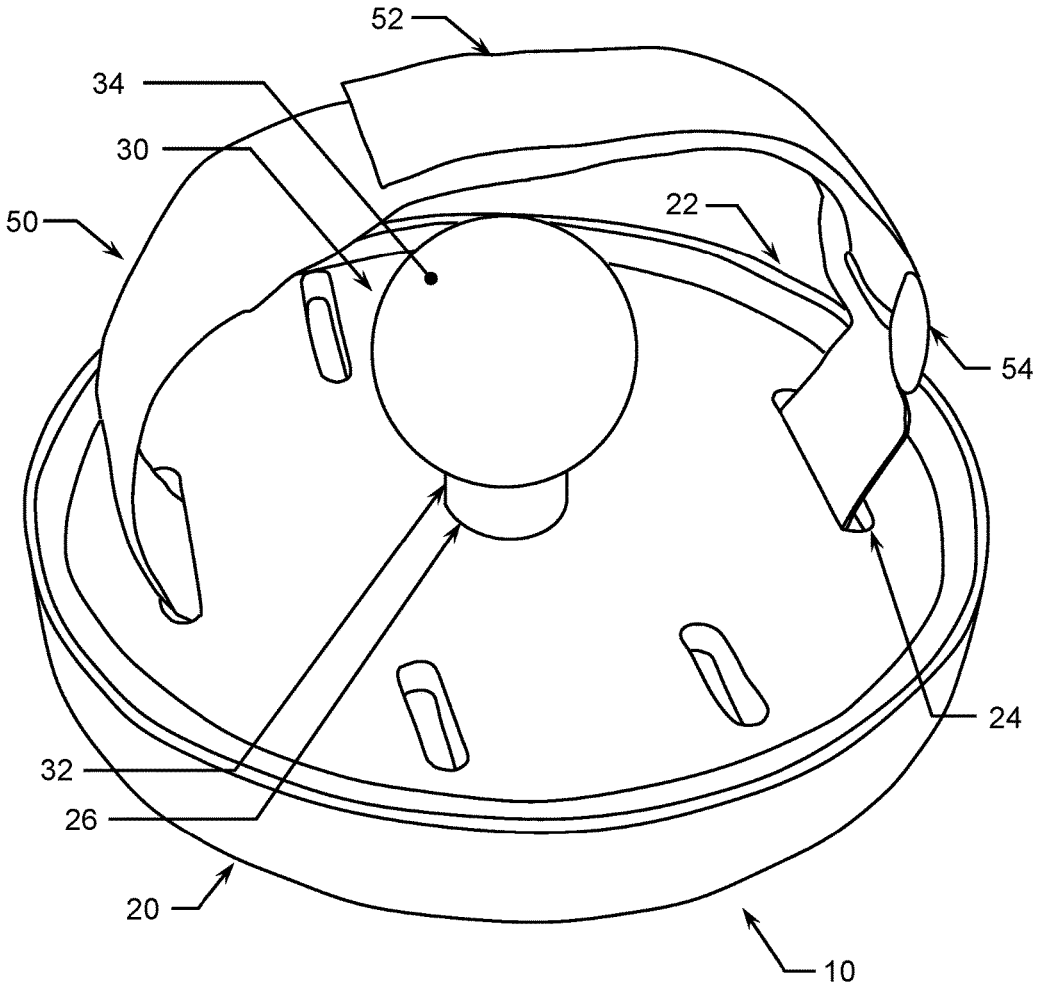
FIG. 1 is a trimetric view of a first embodiment of the invention with the apparatus in an upright position.
Figure 2:
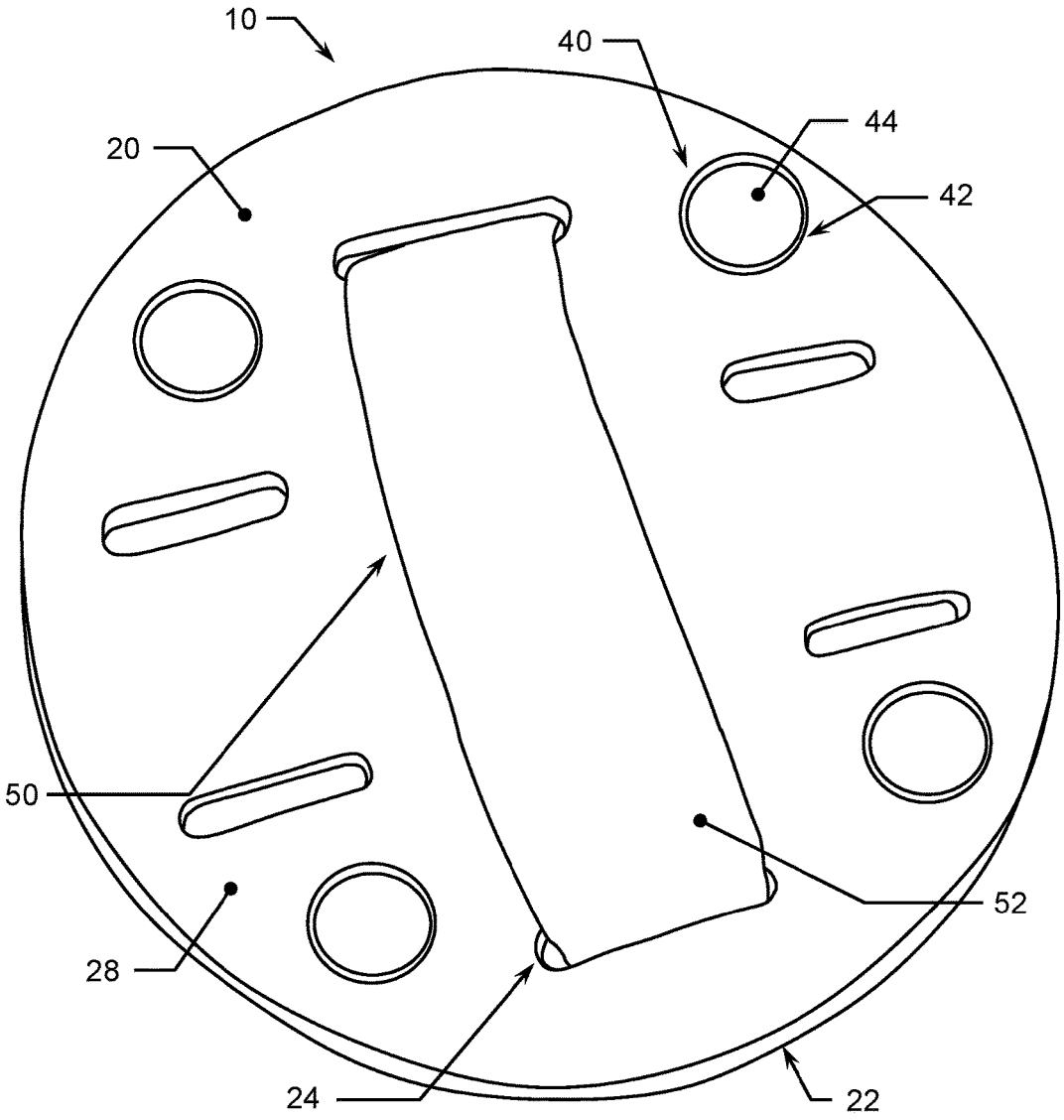
FIG. 2 is a trimetric view of a first embodiment of the invention with the apparatus in an upside-down position and showing a lower surface of the apparatus.
Figure 3:
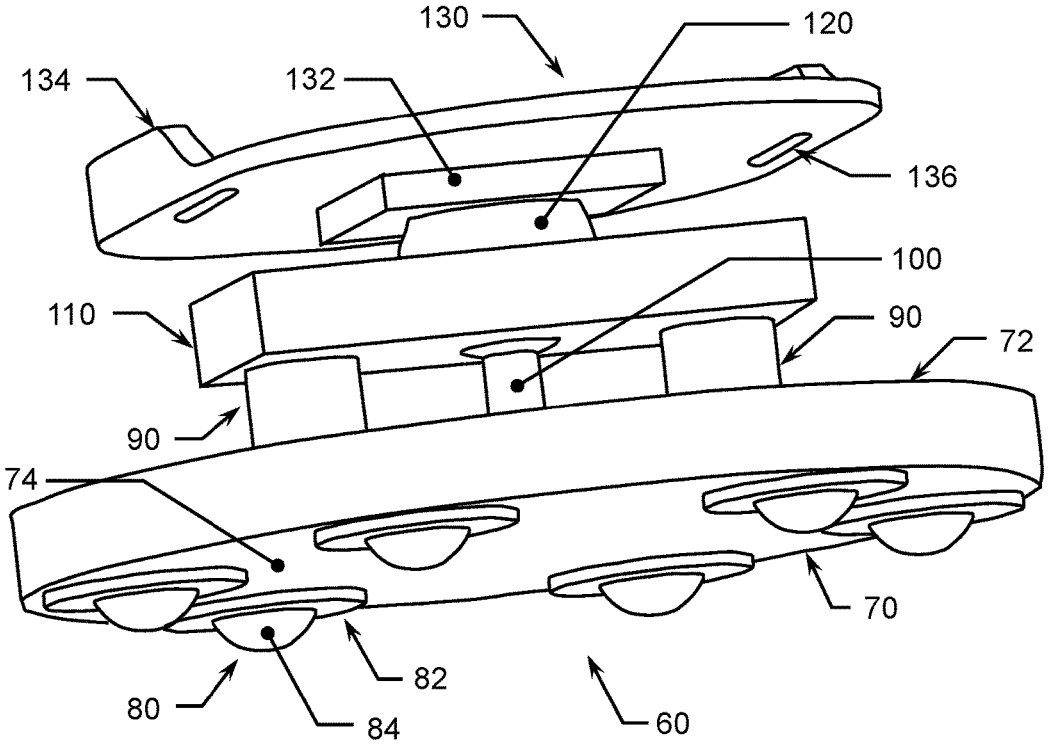
FIG. 3 is a trimetric view of a second embodiment of the invention with the apparatus in a rotated position so as to show a lower surface of the apparatus.
Figure 4:
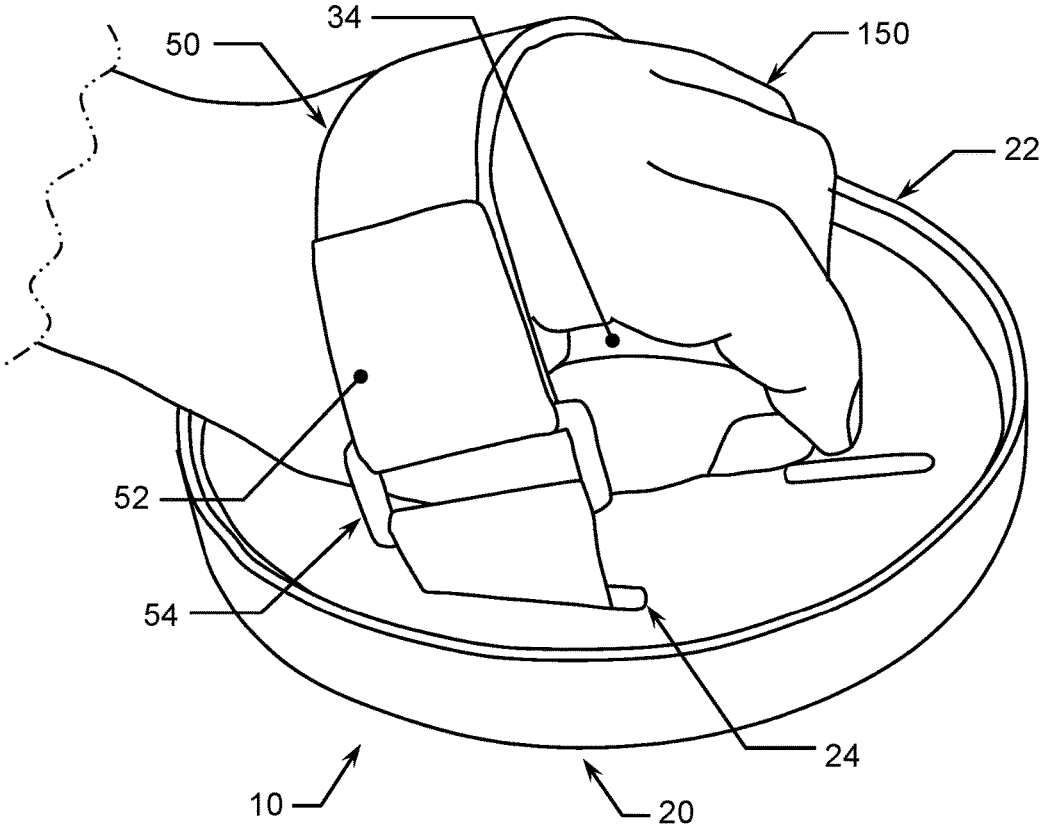
FIG. 4 is a trimetric view of a first embodiment of the invention with the apparatus in an upright position, and with the apparatus shown strapped onto and grasped by a user's hand.
Figure 5:
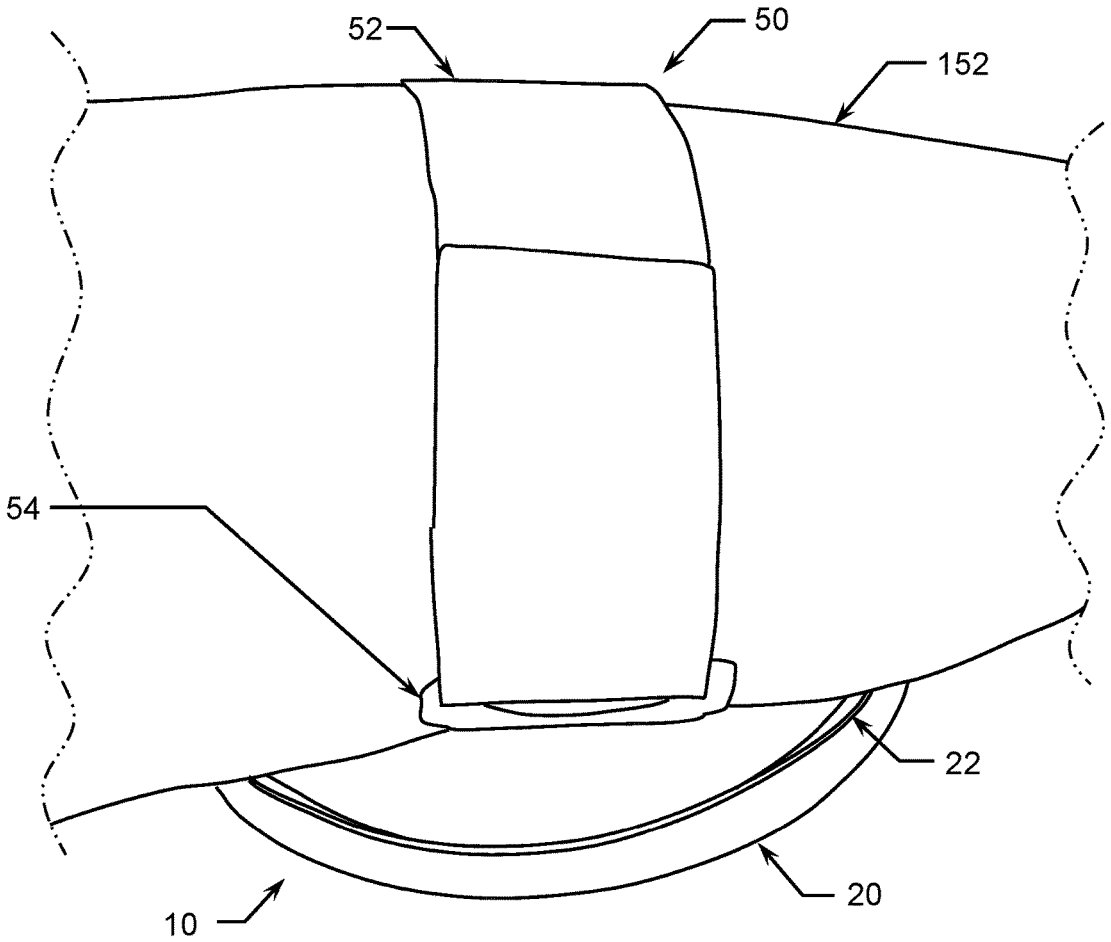
FIG. 5 is a trimetric view of a first embodiment of the invention with the apparatus in an upright position, and with the apparatus shown strapped onto a user's arm.
Figure 6:
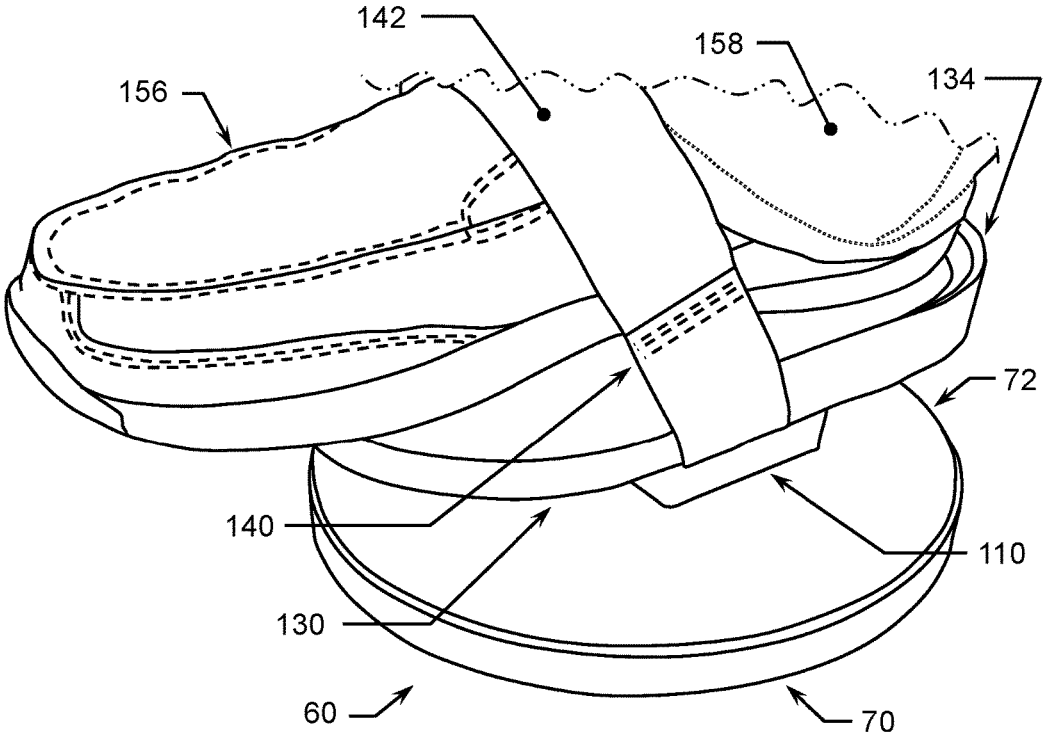
FIG. 6 is a trimetric view of a second embodiment of the invention with the apparatus in an upright position, and with a user's foot positioned in a cradle of the apparatus and with the apparatus shown strapped onto a user's shoed foot.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In order to facilitate the understanding of the present invention in reviewing the drawings accompanying the specification, a feature list is provided below. It is noted that like features are like numbered throughout all of the figures.

FEATURE TABLE

| # | Feature | # | Feature |
|---|---|---|---|
| 10 | RMIA | 22 | Rim |
| 20 | Base | 26 | Handle retention hole |
| 24 | Strap retention slot | 32 | Post |
| 28 | Bottom surface | 42 | Housing |
| 30 | Handle | 52 | VELCRO strap |
| 34 | Knob | 72 | Rim |
| 40 | Roller device | 82 | Housing |
| 44 | Ball | 100 | Support Column |
| 50 | Strap device | 120 | Dampener |
| 54 | Buckle | 132 | Mounting pad |
| 60 | RMIA | 136 | Strap retention slot |
| 70 | Base | 142 | VELCRO strap |
| 74 | Bottom surface | 152 | Arm (user) |
| 80 | Roller device | 156 | Shoe (user) |
| 84 | Ball | | |
| 90 | Spring | | |
| 110 | Spring block | | |

-continued

FEATURE TABLE

| # | Feature | # | Feature |
|---|---|---|---|
| 130 | Cradle | | |
| 134 | Rim | | |
| 140 | Strap device | | |
| 144 | Buckle (not shown) | | |
| 150 | Hand (user) | | |
| 154 | Foot (user-not shown) | | |
| 158 | Pant leg (user) | | |

Referring now to the drawings, the invention is a rehabilitation and mobility improvement apparatus (RMIA) 10 and method of use for use in providing increased mobility in persons having reduced strength and mobility due to for instance injury or illness, comprising a base 20, a handle 30, a plurality of roller devices 40, and a strap device 50.

Base 20 further defines a generally flat disc shaped base having a rim 22, a plurality of strap retention slots 24, a preferably threaded handle retention hole 26, and a bottom surface 28. Base 20 is preferably constructed of a plastic material and may be injection molded, machined, or constructed of another manufacturing method such as an additive manufacturing method (e.g. stereolithography, 3D printing, etc.).

Handle 30 further defines a generally cylindrical metal threaded post 32 connected to a preferably plastic spherical shaped knob 34.

Roller device 40 preferably defines generally low profile roller device comprising a preferably metal housing 42 rotatingly retaining a rollable ball 44. It is noted that roller device 40 preferably defines a COTS (Commercially available Off The Shelf) item and can be purchased from Tool-Orbit and other suppliers—see for instance see Appx B. It is further noted that rather than an encased ball type roller device, roller device 40 may alternatively comprise a wheel caster or other type of roller device.

Strap device 50 further defines a conventional strap device comprising a VELCRO strap 52 connected to a preferably plastic buckle 54.

RMIA 10 is assembled such that post 32 of handle 30 is treaded into handle retention hole 26 of base 20, housings 42 of the plurality of roller devices 40 are rollably fastened to bottom surface 28 of base 20, and VELCRO strap 52 of strap device 50 is threaded through strap retention slots 24 of base 20 and removably attached to itself. It is noted that rather than roller devices 40 being attached to bottom surface 28, bottom surface 28 is alternately adapted such that bottom surface 28 has a substantially low coefficient of friction and more preferably, the friction encountered between bottom surface 28 and an interface surface (e.g. a table top or floor) is substantially less than the friction that would otherwise be encountered between a user's hand or arm and an interface surface (e.g. a table top or floor). For instance, bottom surface 28 is alternately coated with a TEFLON coating.

In practice, RMIA 10 is mounted to a user's hand such as by the user grasping knob 34 and by strap device 50 being secured around the user's hand. The user may then place RMIA 10 on an interface surface such as a table top and move RMIA 10 about the table top with minimal resistance. In this fashion, a user is able to exercise his arm in a way that the user may not otherwise have been able to do due to decreased strength and/or decreased range of motion due to an illness or injury. A particularly useful application of RMIA 10 is to have a user mount RMIA 10 to his hand as described above and rest RMIA 10 on a table top. Another person then rolls a ball towards the user's hand and the user attempts to lightly strike the ball with RMIA 10. When using RMIA 10 in such fashion, rim 22 protects the user's hand from the ball otherwise striking the user's fingers. This type of exercise is excellent for not only improving hand-eye coordination, but for increasing strength and mobility by moving along a variety of different strike paths on the table top.

Alternatively in practice, handle 30 is removed from RMIA 10, and RMIA 10 (without handle 30) is mounted to a user's arm by placing base 20 into contact with the user's arm and securing strap device 50 around the user's arm. The user may then place RMIA 10 on an interface surface such as a table top and move RMIA 10 about the table top with minimal resistance. In this fashion, a user is able to exercise his arm in a way that the user may not otherwise have been able to do due to decreased strength and/or decreased range of motion due to an illness or injury.

Referring now to the drawings, the invention is a rehabilitation and mobility improvement apparatus (RMIA) 60 and method of use for use in providing increased mobility in persons having reduced strength and mobility due to for instance injury or illness, comprising a base 70, a plurality of roller devices 80, a plurality of springs 90, a support column 100, a spring block 110, a dampener 120, a cradle 130, and a strap device 140.

Base 70 further defines a generally flat disc shaped base having a rim 72 and a bottom surface 74. Base 70 is preferably constructed of a plastic material and may be injection molded, machined, or constructed of another manufacturing method such as an additive manufacturing method (e.g. stereolithography, 3D printing, etc.).

Roller device 80 preferably defines generally low profile roller device comprising a preferably metal housing 82 rotatingly retaining a rollable ball 84. It is noted that roller device 80 preferably defines a COTS (Commercially available Off The Shelf) item and can be purchased from Tool-Orbit and other suppliers—see for instance see Appx B. It is further noted that rather than an encased ball type roller device, roller device 80 may alternatively comprise a wheel caster or other type of roller device.

Spring 90 further defines a generally cylindrical metal coil spring. Support column 100 defines a generally cylindrical metal support column. Spring block 110 defines a generally cubic shaped plastic spring block. Dampener 120 defines a pliable and preferably rubber dampener that can both react to and dampenly support a load and allow for multi-axis movement.

Cradle 130 further defines a generally elongated cradle adapted to receive a foot or shoe and having a mounting pad 132, a rim 134, and a plurality of strap retention slots 136. Cradle 130 is preferably constructed of a plastic material and may be injection molded, machined, or constructed of another manufacturing method such as an additive manufacturing method (e.g. stereolithography, 3D printing, etc.).

Strap device 140 further defines a conventional strap device comprising a VELCRO strap 142 connected to a preferably plastic buckle 144 (not shown).

RMIA 60 is assembled such that housings 82 of the plurality of roller devices 80 are rollably fastened to bottom surface 74 of base 70, spring block 110 is moveably and actuatingly connected to base 70 by mounting springs 90 and support column 100 therebetween such that spring block 110 may move toward and away from base 70 along the longitudinal axis of support column 100 by flexing (compressing and stretching) springs 90, dampener 120 is compressibly and flexibly mounted to spring block 110 and to mounting pad 132 of cradle 130, and VELCRO strap 142 of strap device 140 is threaded through strap retention slots 136 of cradle 130 and removably attached to itself. It is noted that rather than roller devices 80 being attached to bottom surface 74, bottom surface 74 is alternately adapted such that bottom surface 74 has a substantially low coefficient of friction and more preferably, the friction encountered between bottom surface 74 and an interface surface (e.g. a table top or floor) is substantially less than the friction that would otherwise be encountered between a user's foot or shoe and an interface surface (e.g. a table top or floor). For instance, bottom surface 74 is alternately coated with a TEFLON coating.

In practice, RMIA 60 is mounted to a user's foot or shoe (with the user's foot shoed or contained therein) such as by the user placing the user's foot in cradle 130 and by strap device 140 being secured around the user's foot. The user may then place RMIA 60 on an interface surface such as a floor and move RMIA 60 about the floor with minimal resistance. In this fashion, a user is able to exercise his leg in a way that the user may not otherwise have been able to do due to decreased strength and/or decreased range of motion due to an illness or injury. It shall be noted that when moving RMIA 60 about the floor such as in a swinging arc motion, the alternating compression and expansion of springs 90 allows RMIA 60 to compensate for the alternatingly increased and decreased proximity of cradle 130 to the floor while constantly keeping roller devices 80 of base 70 in contact with the floor. It is also noted that off-axis motion or motion of RMIA 60 on the floor with roller devices 80 of base 70 in substantial constant contact with the floor may be made while the user's leg is at an angle (other than normal or perpendicular) to the floor. This type of exercise is excellent for not only improving foot-eye coordination, but for increasing strength and mobility by moving along a variety of different paths on the floor.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of using a rehabilitation and mobility improvement apparatus (RMIA) comprising providing a RMIA comprising a base having a low friction contact surface defining at least one roller device mounted to said base, said RMIA further having a retention device removably attached thereto, mounting said RMIA to a user's appendage, and moving said RMIA across an interface surface such that said RMIA is brought into colliding contact with a target object so as to provide for rehabilitation and improved mobility of said appendage.

2. The method of claim 1, wherein said at least one roller device further defines a plurality of roller devices, each of said roller devices further defining a singular ball rollingly enclosed in a housing.

3. The method of claim 1, wherein said retention device further defines a hook and loop mounting strap, and wherein said RMIA further includes a detachable and reattachable handle mounted thereto.

4. The method of claim 1, wherein said RMIA further includes a cradle flexibly connected to said base and adapted such that when said base is moved across an interface surface said cradle may be in a flexed off-axis position relative to said base.

5. The method of claim 4, wherein said cradle is configured to be attached to an appendage of a human user.

6. A method of using a rehabilitation and mobility improvement apparatus (RMIA) comprising providing a RMIA comprising a base having a low friction contact surface and a cradle flexibly connected to said base and adapted such that when said base is moved across an interface surface said cradle may be in a flexed off-axis position relative to said base, said RMIA further having a retention device removably attached thereto, mounting said RMIA to a user's appendage, and moving said RMIA across an interface surface such that said RMIA is brought into colliding contact with a target object so as to provide for rehabilitation and improved mobility of said appendage.

7. The method of claim 6, wherein said low friction contact surface further defines a plurality of roller devices mounted to said base.

8. The method of claim 7, wherein said plurality of roller devices further defines at least three roller devices, each of said roller devices further defining a singular ball rollingly enclosed in a housing.

9. The method of claim 6, wherein said retention device further defines a hook and loop mounting strap, and wherein said RMIA further includes a detachable and reattachable handle mounted thereto.

10. The method of claim 6, wherein said cradle is configured to be attached to an appendage of a human user.

11. A method of using a rehabilitation and mobility improvement apparatus (RMIA) comprising providing a RMIA comprising a base having a low friction contact surface defining at least one roller device mounted to said base, said RMIA further having a hook and loop mounting strap retention device removably attached thereto, mounting said RMIA to a user's appendage, and moving said RMIA across an interface surface such that said RMIA is brought into colliding contact with a target object so as to provide for rehabilitation and improved mobility of said appendage.

12. The method of claim 11, wherein said at least one roller device further defines a plurality of roller devices, each of said roller devices further defining a singular ball rollingly enclosed in a housing.

13. The method of claim 11, wherein said RMIA further includes a detachable and reattachable substantially spherical knob handle mounted thereto.

14. The method of claim 11, wherein said RMIA further includes a cradle flexibly connected to said base and adapted such that when said base is moved across an interface surface said cradle may be in a flexed off-axis position relative to said base.

15. The method of claim 14, wherein said cradle is configured to be attached to an appendage of a human user.

16. A method of using a rehabilitation and mobility improvement apparatus (RMIA) comprising providing a RMIA comprising a base having a low friction contact surface and a cradle flexibly connected to said base and adapted such that when said base is moved across an interface surface said cradle may be in a flexed off-axis position relative to said base, said RMIA further having a hook and loop mounting strap retention device removably attached thereto, mounting said RMIA to a user's appendage, and moving said RMIA across an interface surface such that said RMIA is brought into colliding contact with a target object so as to provide for rehabilitation and improved mobility of said appendage.

17. The method of claim 16, wherein said low friction contact surface further defines a plurality of roller devices mounted to said base.

18. The method of claim 17, wherein said plurality of roller devices further defines at least four roller devices, each of said roller devices further defining a singular ball rollingly enclosed in a housing.

19. The method of claim 16, wherein said RMIA further includes a detachable and reattachable handle mounted thereto.

20. The method of claim 16, wherein said cradle is configured to be attached to an appendage of a human user.

* * * * *